US005785565A

United States Patent [19]

Forman

[11] Patent Number: 5,785,565

[45] Date of Patent: Jul. 28, 1998

[54] ILLUMINATED SWIMMING FLIPPER AND ASSOCIATED METHOD MANUFACTURE

[76] Inventor: Aaron Forman, 3008 Bedminster Rd., Perkasie, Pa. 18944

[21] Appl. No.: 900,723

[22] Filed: Jul. 25, 1997

[51] Int. Cl.[6] ..... A63B 31/10

[52] U.S. Cl. ..... 441/64; 114/315

[58] Field of Search ..... 441/61–64; 114/315; D21/239

[56] References Cited

U.S. PATENT DOCUMENTS 5,494,468 2/1996 Demarco, Jr. ..... 441/64

*Primary Examiner*—Jesus D. Sotelo

*Attorney, Agent, or Firm*—LaMorte & Associates

[57] ABSTRACT

A swimming flipper device that is worn on the foot of a person while swimming in the water. The flipper device has an exterior surface that is viewable from points surrounding the flipper. At least one source of light is coupled to the exterior surface of the flipper, wherein each source of light is viewable from the points surrounding the flipper. The sources of light can be light emitting diodes, chemical-luminescent devices or optical fibers coupled to a central illumination source.

19 Claims, 6 Drawing Sheets

ILLUMINATED SWIMMING FLIPPER AND ASSOCIATED METHOD MANUFACTURE

BACKGROUND OF THE INVENTION

1. Field of the Invention

The present invention relates in general to swimming flippers that are worn on the feet of swimmers and divers. More particularly, the present invention relates to swimming flippers and other aquatic devices that are designed to be more visible in dark or murky water.

2. Description of the Prior Art

In the sport of scuba diving, it is recommended that a diver always dive with at least one partner. In this manner, if one diver has an equipment failure, medical problems or otherwise gets into trouble, there is also someone around to help. One diver can only help another diver if the first diver sees the second diver and recognizes that the second diver needs help. For this reason, divers try to stay in view of each other during a dive. If for some reason one diver were to lose sight of his/her partner, it is often very difficult to reestablish contact. Under water one diver can not call to another. As a result, if visual contact is lost, the divers must often abort the dive and return to the surface.

In clear water and on sunny days, the visibility during a shallow dive is good and it is not difficult to keep a diving partner in sight. However, when diving at night, in deep water or in murky water, the visibility is very low. In such low visibility diving conditions, one diver can lose sight of his/her diving partner who may be only a few feet away. While diving during low visibility conditions, divers bring lights with them to help increase visibility. The prior art is replete with different types of underwater lights that are designed to be carried by divers. Most lights used by divers are versions of an underwater flashlight, wherein the lights are battery powered and are carried in the hand of the diver. As a diver swims, the diver points the flashlight in the direction that the diver wants to see. As a result, if a diver is swimming forward, that diver typically is holding the flashlight in the forward direction to see what is approaching. During low visibility conditions, a diver commonly can not see his/her diving partner, but rather can only see the light carried by his/her diving partner. If a diver turns the light away from his/her partner in order to swim in a particular direction, the diver's body may block the light from being seen from his/her partner. The divers then can become easily separated and the dive must be aborted.

A need therefore exists in the art for a secondary source of illumination that can be carried by a diver, wherein the purpose of the secondary illumination source is not to illuminate objects for the diver to see but rather is to help identify the position of a diver in the water so that the diver's partners can better keep track of the diver.

This need is provided for by the present invention as set forth in the below description and claims.

SUMMARY OF THE INVENTION

The present invention is a swimming flipper device that is worn on the foot of a person while swimming in the water. The flipper device has an exterior surface that is viewable from points surrounding the flipper. At least one source of light is coupled to the exterior surface of the flipper, wherein each source of light is viewable from the points surrounding the flipper. The sources of light can be light emitting diodes, chemical-luminescent devices or optical fibers coupled to a central illumination source. If power is required to light the source of light, batteries are provided in a water imperious structure that is affixed to the flipper. As a person is swimming in water with a low visibility, the lights are lit. A diver's flipper therefore becomes illuminated and is more readily viewed in the water by another diver swimming behind the first diver.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE INVENTION

When a first diver is swimming away from a second diver, the distal tip of the first diver's flippers is commonly the point on that diver that faces the second diver and is closest to that second diver. The present invention is an illumination system for swimming flippers that places multiple illumination sources at the end of each flipper. As a result, as a first diver swims away from a second diver, the second diver can easily view the first diver's flippers. The second diver can therefore keep better track of the first diver during dives in water with low visibility.

Figure 1:
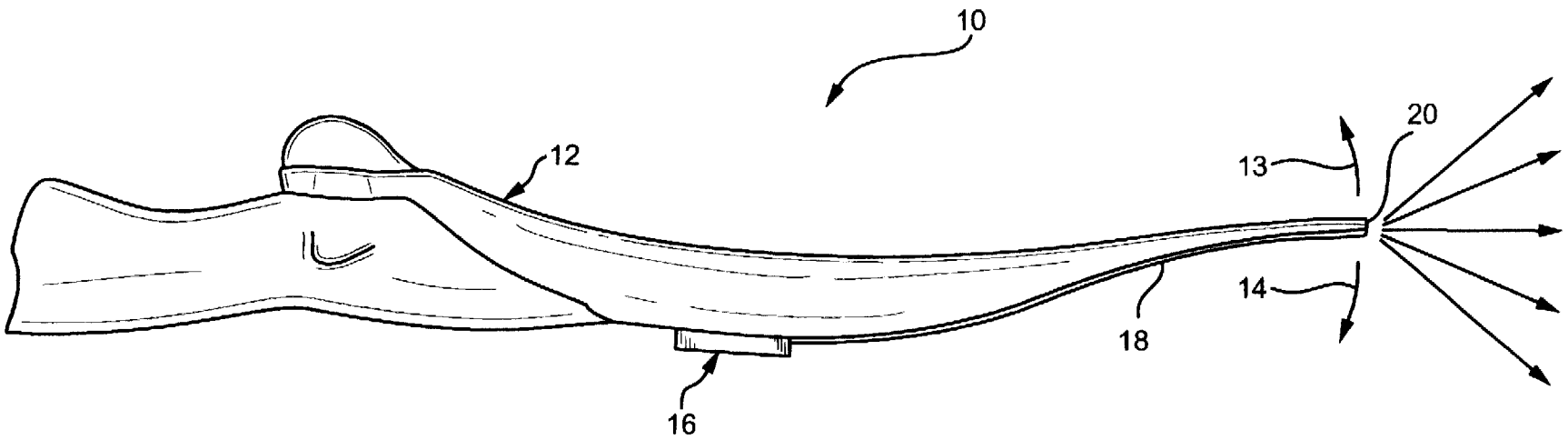
FIG. 1 side view of a swimmer's foot wearing a flipper device in accordance with the present invention.

Referring to FIG. 1, a first exemplary embodiment of the present invention flipper device 10 is shown. The flipper device 10 attaches to the foot and provides an enlarged surface area to the foot that is useful in displacing water during swimming. The base flipper 12 is made of an elastomeric material that enables the base flipper 12 to bend in the directions of arrow 13 and arrow 14. The prior art record contains dozens of different swimming base flipper designs. Any such base flipper design can be adapted for use with the present invention.

Figure 2:
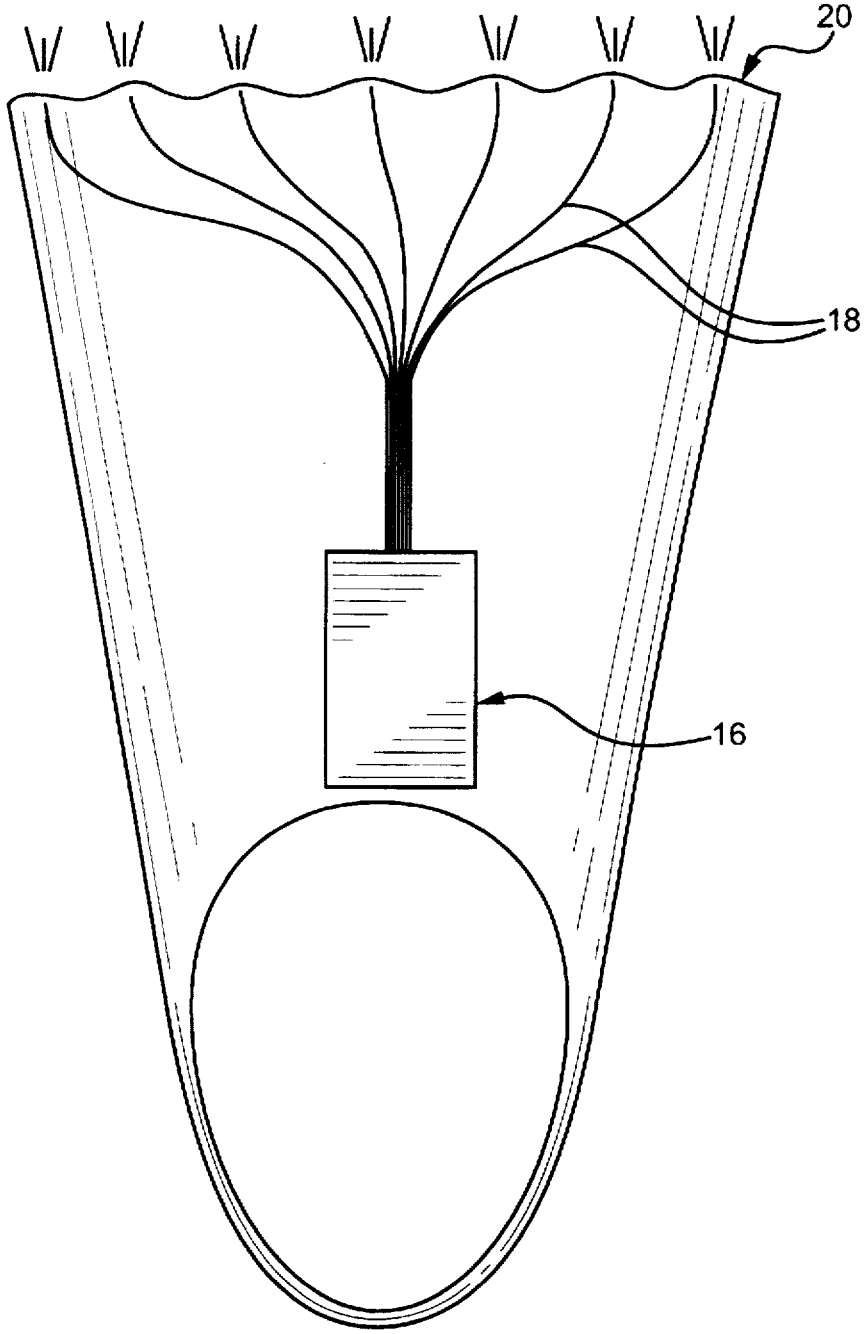
FIG. 2 is a top view of an exemplary embodiment of the present invention flipper device.

Referring to FIG. 2 in conjunction with FIG. 1, it can be seen that a small water tight housing 16 is affixed to the exterior of the base flipper 12. The housing 16 can be mechanically connected to the base flipper 12, adhesively adhered to the base flipper 12 or molded directly into the material of the base flipper 12. Flexible optical fibers 18 extend from the housing 16. The optical fibers 18 terminate at different points along the distal end 20 of the base flipper 12. Like the housing 16, the optical fibers 18 can be mechanically connected to the base flipper 12, adhesively adhered to the base flipper 12 or molded directly into the material of the base flipper 12. The optical fibers 18 can have any diameter and can be made of any optical conduit material that enables the optical fibers 18 to bend with the material of the base flipper 12 without breakage.

Figure 3:
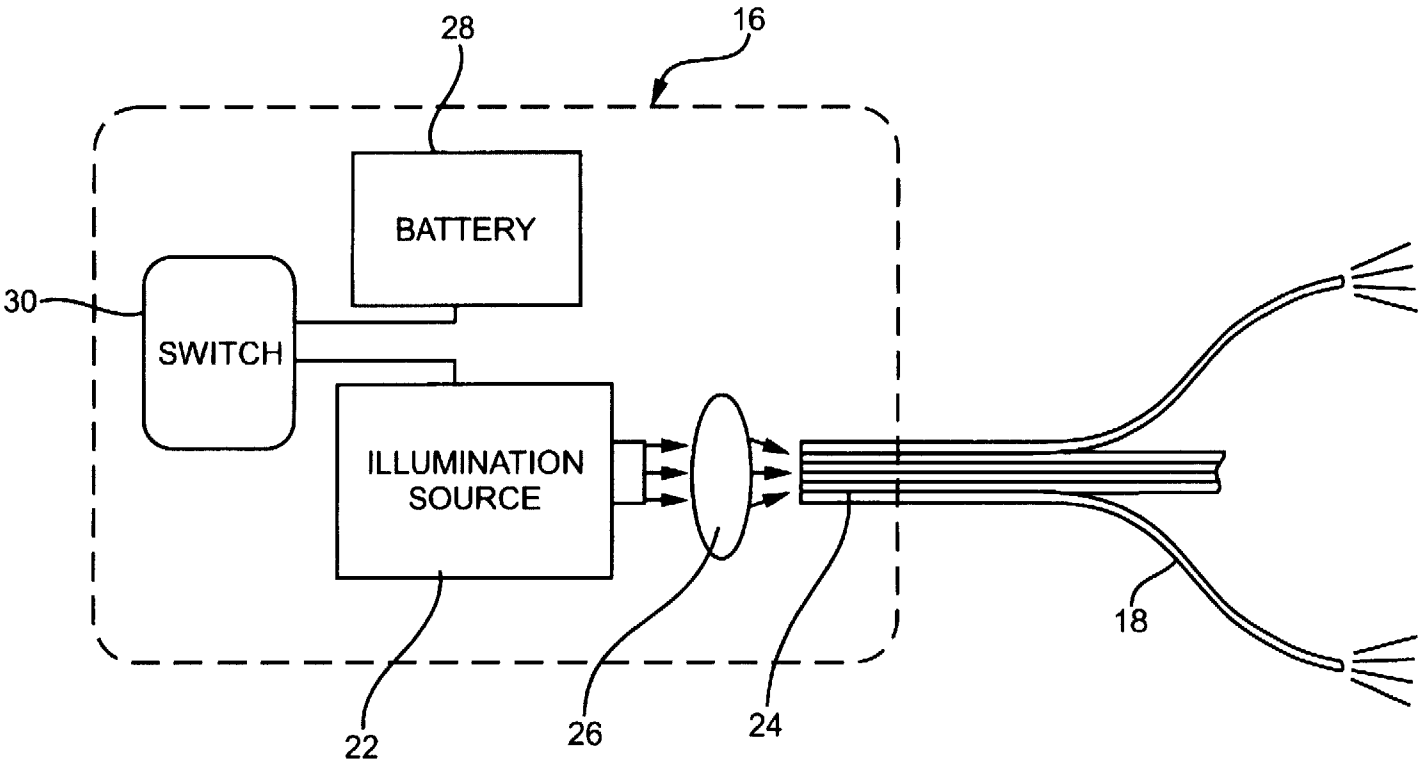
FIG. 3 is a block diagram schematic illustrating the electro-optical components of the exemplary embodiment shown in FIG. 2.

Referring to FIG. 3, it can be seen that an illumination source 22 is contained within the water tight housing 16. The various optical fibers 18 enter the housing 16 and are combined into an optical bundle 24. The point where the optical fibers 18 enter the housing 16 is sealed with a sealant to maintain the water impervious integrity of the housing 18. The illumination source 22 creates a beam of light that is directed onto the face of the fiber bundle 24. Optical elements 26 may or may not be used to focus the light onto the fiber bundle 24 depending upon the characteristics of the illumination source 22. As the light from the illumination source 22 impinges upon the fiber bundle 24, the light is received by each of the optical fibers 18. The optical fibers 18 propagate the received light to the opposite output end of each of the fibers. The light exits the optical fibers 18 shining in a direction away from the base flipper. As a result, as a diver swims away from a point, the light emanating from that diver's flipper's will be directed toward that point. Consequently, if a diver inadvertently swims away from his/her partner, the light from that diver's flippers will shine toward that diver's partner.

The illumination source 22 is powered by a battery 28 that is contained within the water tight housing 16. An on/off switch 30 is disposed in between the battery 28 and the illumination source 22 so that the illumination source 22 can be selectively turned "on" and "off" as needed.

Figure 4:
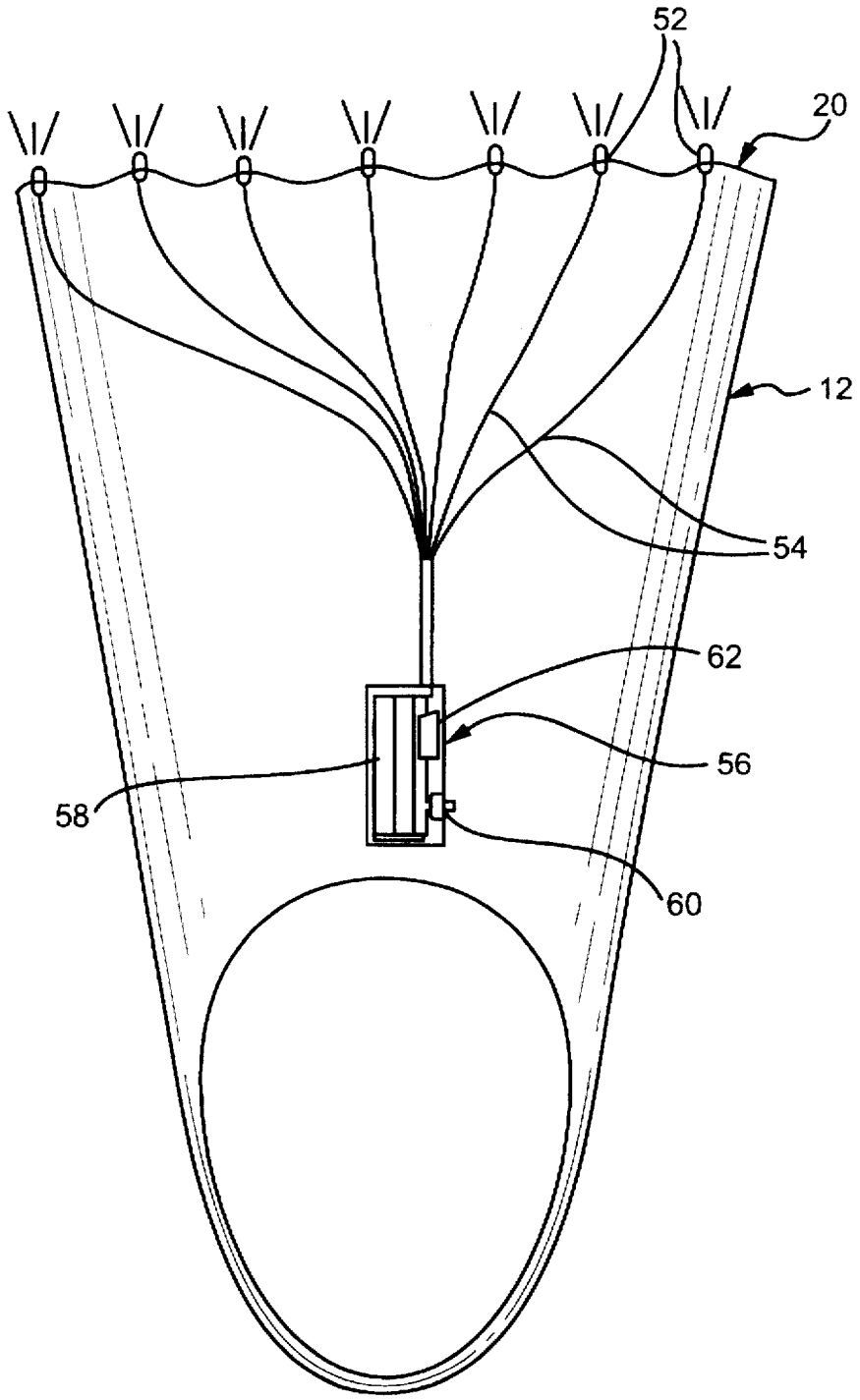
FIG. 4 is a top view of a second exemplary embodiment of the present invention flipper device.

Referring to FIG. 4, an alternate embodiment of the present invention flipper device 50 is shown. In this embodiment, optical fibers are not used. Rather, in the shown embodiment, individual light emitting diodes (LEDs) 52 are coupled to the distal end 20 of the base flipper 12. The LEDs 52 can be mechanically and/or adhesively affixed to the material of the base flipper 12. Conductive leads 54 extend from each of the LEDs 52 and lead to a water tight housing 56. Both the conductive leads 54 and the housing 56 can be mechanically connected to the base flipper 12, adhesively adhered to the base flipper 12 or molded directly into the material of the base flipper 12. The housing 56 contains at least one battery 58 and a switch 60 for selectively interconnecting the battery 58 with the conductive leads 54. When the switch 60 is turned to the "on" position, a circuit is complete and the various LEDs 52 are powered by the battery 58. The LEDs 52 can be of any known type and can be any one color or series of colors.

An optional control circuit 62 can also be contained within the water tight housing 12. The control circuit 62 can cause the LEDs 52 to flash in any sequence so desired.

Figure 5:
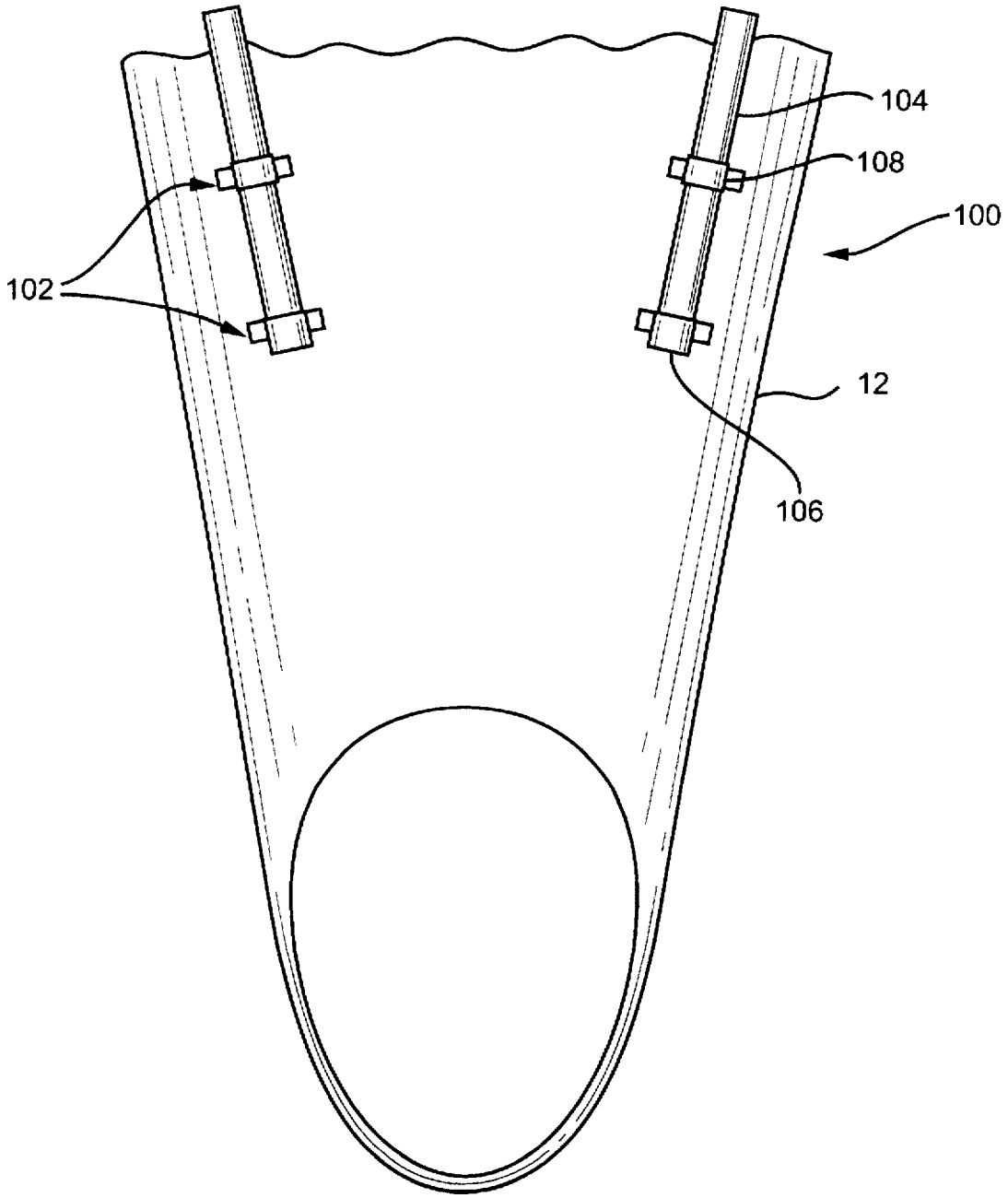
FIG. 5 is a top view of a third exemplary embodiment of the present invention flipper device.

Referring to FIG. 5, there is shown another alternate embodiment of the present invention flipper device 100. In this embodiment, retaining structures 102 are formed on the exterior surface of the base flipper 12. The retaining structures 102 are designed to mechanically retain chemical-luminescent devices 104 in a set position on exterior of the base flipper 12. Chemical-luminescent devices contain two compounds that produce light when mixed. The two compounds are separated from each other by a breakable barrier within the structure of a plastic cylinder, commonly referred to as a "stick". When the stick is bent, the internal breakable barrier ruptures, the compounds mix and light is produced. Chemical-luminescent devices 104 are well known commercially available products. Inexpensive chemical-luminescent devices 104 can produce light at different intensities for any period of time up to twelve hours.

In the shown embodiment, the retaining structures 102 contain and end cap 106 that receives the end of a chemical-luminescent device 104. Clamping elements 108 are disposed in line with each of the end caps 106. To apply a chemical-luminescent device 104 to the base flipper 12, the chemical-luminescent device 104 is first activated to start the production of light. The chemical-luminescent device 104 is then passed under one of the clamping elements 108 until the end of the chemical luminescent device 104 enters the end cap 106. The clamping element 108 is then tightened over the chemical-luminescent device 104 and the chemical luminescent device 104 is mechanically locked into position. After a chemical-luminescent device 104 stops producing light, it can be removed and replaced.

Figure 6:
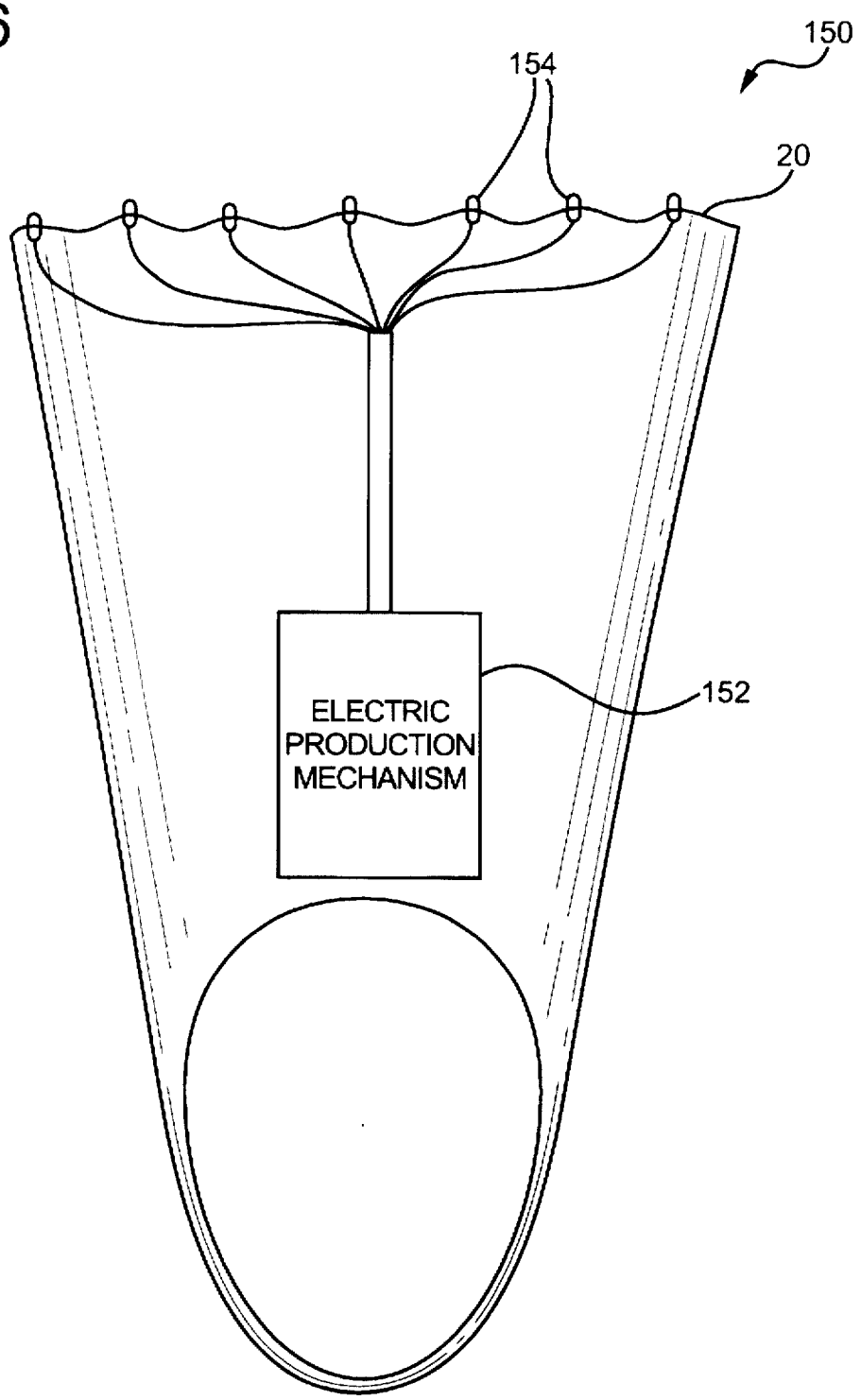
FIG. 6 is a top view of a fourth exemplary embodiment of the present invention flipper device.

Referring to FIG. 6, yet another embodiment of the present invention flipper device 150 is shown. In this embodiment, the structure of the flipper device 150 contains an integral electric production mechanism 152, wherein the mechanical deformation of the flipper during swimming is converted into electricity. The structure of such an integral electric production mechanism 152 is disclosed in U.S. Pat. No. 5,494,468 to Demarco, issued Feb. 27, 1996, which is herein incorporated into this disclosure by reference. Once the integral electric production mechanism 152 produces the needed electricity, the electricity can be used to light LEDs 154 positioned at the distal end 20 of the flipper.

It will be understood that the embodiments of the present invention described and illustrated herein are merely exemplary and a person skilled in the art can make many variations to the embodiments shown without departing from the scope of the present invention. It should also be understood that the various elements from the different embodiments shown can be mixed together to create alternate embodiments that are not specifically described. All such variations, modifications and alternate embodiments are intended to be included within the scope of the present invention as defined by the appended claims.

What is claimed is:

1. A flipper device, for use on the foot when swimming, having an exterior surface and at least one source of light coupled to said exterior surface.

2. The device according to claim 1, wherein said at least one source of light includes an light emitting diode.

3. The device according to claim 1, wherein said at least one source of light includes an optical fiber.

4. The device according to claim 3, further including an illumination source optically coupled to each said optical fiber.

5. The device according to claim 1, wherein said at least one source of light includes a chemical-luminescent element.

6. The device according to claim 1, further including a water impervious housing accessible from said exterior surface.

7. The device according to claim 1, further including a power source for powering said at least one source of light.

8. The device according to claim 1, further including an on/off switch for selectively controlling said at least one source of light.

9. The device according to claim 1, wherein said flipper device contains a first end for receiving a foot and an opposite distal end, and said at least one light source is disposed proximate said distal end.

10. The device according to claim 8, wherein said at least one light source is configured to contain a plurality of light sources disposed along said distal end.

11. The device according to claim 1, further including a controller for selectively flashing said at least one source of light.

12. The device according to claim 1, further including a power generating mechanism for generating electrical power and powering said at least one source of light.

13. A flipper device, comprising a first end and an opposite second end;

a plurality of light emitting elements disposed along said second end; and a power source electrically coupled to said light emitting elements for powering said light emitting elements.

14. The device according to claim 13, further including a switch disposed between said power source and said light emitting elements for selectively controlling the flow of power between said power source and said light emitting elements.

15. The device according to claim 13 further including a control circuit for selectively controlling the flow of power in between said power source and said light emitting elements.

16. The method of manufacturing a swimming flipper, comprising the steps of:

providing a flipper element having a first end adapted to receive a foot and a second opposite distal end; and coupling at least one light emitting element to said flipper element proximate said distal end, wherein said at least one light emitting element is viewable from points surrounding said flipper element.

17. The method according to claim 16, wherein said at least one light emitting element is configured to contain a plurality of light emitting elements.

18. The method according to claim 16, wherein said at least one light emitting element is selected from a group consisting of optical fibers, light emitting diodes and chemical-luminescent elements.

19. The method according to claim 16 further including the step of providing a switch for selectively controlling the operation of said at least one light source.

* * * * *